US005527244A

United States Patent [19]

Waller et al.

[11] Patent Number: 5,527,244

[45] Date of Patent: Jun. 18, 1996

[54] BIDIRECTIONALLY EXERCISE GLOVE

[76] Inventors: John F. Waller, 90 Inwood Ave., Pointlookout, N.Y. 11569; Arnold Tobin, 192-06 Ave., St. Albans, New York, N.Y. 11413

[21] Appl. No.: 170,499

[22] Filed: Dec. 20, 1993

[51] Int. Cl.[6] ..... A63B 23/16

[52] U.S. Cl. ..... 482/47; 482/49; 482/124

[58] Field of Search ..... 482/44–50, 124; 601/40; 2/161.1, 161.2, 161.6; 602/21

[56] References Cited

U.S. PATENT DOCUMENTS

| | | | |
|---|---|---|---|
| 2,736,034 | 2/1956 | Fredenhagen | 482/47 |
| 3,597,765 | 8/1971 | Stanton | 2/161.1 X |
| 3,944,220 | 3/1976 | Fasano | 482/47 |
| 4,051,553 | 10/1977 | Howard | 2/161.1 |
| 4,146,935 | 4/1979 | Hinton | 2/161.3 |
| 4,281,647 | 8/1981 | Antypas | 602/21 |
| 4,635,300 | 1/1982 | Rhee | 2/161.1 |
| 4,706,658 | 11/1987 | Cronin | 602/21 X |
| 4,751,749 | 6/1988 | Cowhey | 2/161 A |
| 4,830,360 | 5/1989 | Carr, Jr. | 482/47 |
| 4,930,162 | 6/1990 | Côté | 2/16 X |
| 4,984,300 | 1/1991 | Cho | 2/16 X |
| 5,043,209 | 8/1991 | Boissé et al. | 428/233 |

*Primary Examiner*—Richard J. Apley
*Assistant Examiner*—John Mulcahy
*Attorney, Agent, or Firm*—Ward & Olivo

[57] ABSTRACT

A bidirectional exercise glove is molded from elastic material in a shape such that the glove biases the wearer's hand to a relaxed position in which the wrist is cocked up 30° and the fingers and thumb are positioned in their relaxed, equilibrium positions, approximately one-third closed. Rods embedded along the fingers of the glove resist flexion and extension of the fingers. Alternatively, flexion and extension of the fingers are resisted by thick molded regions formed integrally with the glove about the fingers.

8 Claims, 3 Drawing Sheets

BIDIRECTIONALLY EXERCISE GLOVE

1. BACKGROUND OF THE INVENTION

1.1. Field of the Invention

The present invention relates generally to devices for exercising the fingers and hands and, more particularly, to a compact glove device which provides resistance during both grasping and extending motions. For example, the present invention can be used to promote hand and finger strength and finger coordination, as well as forearm strength.

1.2. Description of the Prior Art

The human musco-skeletal arrangement with its connective tissues and tendons on many occasions is benefited by a regular program of exercise. For example, broken bones usually require that the affected site be immobilized until the fracture has united, after which muscle atrophy and joint stiffness will be found. Physiotherapy is of great help in the mobilization of the stiffened limb, but active movements and active muscle contractions by the patient are usually the ultimate key to success.

In addition, the connective tissue between the muscle and bones are subject to numerous types of diseases that may ultimately destroy the usefulness and movement of the appendages, and in particular the appendages of the fingers and hands. Such diseases are typically identified as an arthritis, and are used to describe the conditions arising from involvement of the joints and their immediate surrounding structures by disease. The most usual symptoms of these diseases are the stiffness and aching that accompany the movement of any affected joint. Other diseases, such as repetitive stress disorders and "tennis elbow" are also common. In some cases, rest for the individually involved joint is necessary, and in some cases, it is best for the joint to be kept as straight as possible, not flexed or bent. To such ends resting splints have been devised particularly for the fingers, hands, and wrists to be worn at night. Rest of the affected joint does not mean immobilization, however. In order to prevent loss of muscle power and to avoid crippling joint deformity, rest must be accomplished by an active, prescribed exercise program. Such programs once demonstrated to the patient may then be carried on in a home environment. For a patient with a degenerative arthritis condition, physiotherapy, local heat, massages, and supervised exercise enable a patient to carry on for many months in moderate comfort.

Where prescribed by a medical therapist, the application of heat is one of the most effective measures for temporary relief of aches and pains of affected muscle and connective joints and also aids muscles to relax, making exercises more effective. Heat therapy is of several types-dry heat, wet heat, and use of counter irritants (as recommended). Dry heat may be applied by filament lamps, bakers, hot water bottles, electric pads or paraffin baths. Wet heat is applied by hot water, hot fomentations, and contrast baths. Counter irritants usually consist of various liniments and ointments containing irritant substances which, when applied to the skin, cause a reflex dilation of blood vessels, producing a local feeling of warmth.

As to exercise, various devices are known for exercising the hand during a grasping motion. Generally, these devices are intended to increase grip strength. They are used by tennis players, climbers or other athletes, as well as individuals suffering from repetitive stress disorders, arthritis and the like.

One familiar grip strength training device employs a spring coil to provide resistance as a user grasps and closes two handles together. Other similar devices forces a user to squeeze an elastic spongy article (made from neoprene or the like) in a similar grasping motion.

Hand training devices and methods also find use in sports medicine and physical rehabilitation. Injuries or disabilities such as tennis elbow or weakness secondary to age often require finger training exercises such as flexion and/or extension.

While these, as well as other similar training devices, provide adequate training of the grasping motion, both provide no training whatsoever for the opening or extending motion. Moreover, these familiar devices are easily lost during an exercise class or training session since they are not affixed to the hand or body, and are not convenient for use during other activities where the use of a glove would be inconspicuous or otherwise convenient.

Another disadvantage of conventional "grip training" devices is that, with such devices, the training stroke (i.e., the grasping motion) begins with the fingers in an extended, rather than relaxed, position. In all applications, it is preferable that the training stroke begin from a relaxed or neutral position (i.e., a position in which the wrist is cocked up 30° and the fingers and thumb are positioned in their relaxed, equilibrium positions, approximately one third closed). With conventional devices, the user must squeeze the apparatus to reach the relaxed position. Thus, the training stroke does not begin from the relaxed position.

Other prior art devices especially used for the exercise of the hands are described in U.S. Pat. No. 4,730,827 granted to Williams and Great Britain patent 206,592 dated 12-86 to Gree. The patents generally disclose the prior art devices that are ball-like in nature and usually made from a rubber material or other mechanical arrangement that is compressible in one direction as they are gripped by the hand. Gree specifically points out that "there is generally no provision for accommodating with a single hand exerciser all of the movements associated with the parts of the anatomy in question. It is a universally acknowledged fact in physiotherapy that neuromuscular progress is dependent on the ability to stimulate muscles from different angles with use of different exercises and training principles."

The devices shown in the above described patents seem to contact the fingers in a line or point contact mode and do not provide an overall or continuous environment of resistance against which the fingers, hands and other co-ordinating muscles may work in an efficient manner.

The prior art also discloses a variety of exercise or sport-type gloves. These range from sport gloves for providing grip to exercise gloves having discreet weights placed in the fingertips in order to resist the movement of the fingers and thereby strengthen the finger muscles. U.S. Pat. No. 2,736,034 discloses such a fingertip-type weighted device. Each finger tip of the glove has a discreet weight to resist the motion of the fingers when the glove is being worn. This device is particularly suited for operations, such as typing and playing musical instruments. The U.S. Pat. No. 2,736,034 device is dependent on gravity for the direction of its resistance and only exercises the muscles which lift the fingers. The device is totally devoid of any assistance or exercise to the wrist, forearm, upper arm, or back of the hand. Other devices, such as those disclosed in U.S. Pat. Nos. 4,138,100 or 4,197,592 or 3,707,730, are typically suited more for grip and hand formation than for exercise and muscle development in the wrists, forearms and upper arms.

U.S. Pat. No. 3,944,220 discloses a glove and hand exerciser having a plurality of discreet stiffening elements inserted into the glove and each finger canal to resist the movement of the fingers through a cantilever type stiffening action. However, this type of glove and hand exercise does not provide the type of multi-directional resistance necessary to strengthen the fingers, wrists, forearms and upper arms.

Finally, U.S. Patent No. 4,751,749 describes a training glove wherein padding embedded in the glove enhances the glove's resistance to a finger extension stroke. The '749 glove, however, does not provide enhanced resistance to a finger flexion stroke.

2. SUMMARY OF THE INVENTION

In view of the above, one object of the present invention is to provide an apparatus for training the fingers which eliminates one or more of the previously noted disadvantages with prior art training devices.

Another object of the invention is an apparatus and method for training the fingers wherein the training stroke begins from a relaxed position.

Yet another object of the invention is an apparatus and method for training the extension motion of the fingers.

Still another object of the invention is an apparatus and method for bidirectionally (i.e., during both extending and flexing) resisting the motion of the fingers.

In accordance with the present invention, one or more of the above objects are realized by a molded excercise glove and a method for operating the same. In one embodiment, the glove is molded from an elastic material (such as neoprene)—or other elastomers or engineering plastics, as detailed below—in a shape that resembles the hand in its relaxed position. When not being worn, the glove assumes a relaxed position. Similarly, if the wearer relaxes his/her hand, the glove will tend to pull the wearer's fingers into the relaxed position.

To enhance the training resistance, pliable or elastic support rods may be advantageously embedded into the glove. For example, to augment the resistance during an extension stroke, one or more support members are preferably embedded in the molded, glove along the outside of one or more of the fingers. Likewise, to augment the resistance during a flexion stroke, similar support members may be embedded along the insides of the fingers. Where the support members are formed from an elastic material, such as plastic or metal, the members are preferably molded to conform to the fingers in their relaxed positions.

In accordance with a second embodiment of the invention, certain regions of the molded glove are made thicker or thinner to enhance or reduce the resistance to flexing and/or extending motions of one or more of the fingers. For example, if the glove is formed from a material with a higher coefficient of extension than compression, the glove's resistance to the finger extension stroke can be increased by increasing the thickness of the glove along the inner Side of the fingers, and the glove's resistance to the finger flexion stroke can be increased by increasing the thickness of the glove along the outside of the fingers. Conversely, if the glove is formed from a material with a higher coefficient of compression than extension, the glove's resistance to the finger extension stroke can be increased by increasing the thickness of the glove along the outer side of the fingers, and the glove's resistance to the finger flexion stroke can be increased by increasing the thickness of the glove along the inner side of the fingers.

In accordance with the invention, a method for exercising the fingers utilizes the glove to provide resistance during a series of repetitive training strokes. Each training stroke begins from a relaxed position and involves an extending or flexing motion by one or more of the fingers. In accordance with the invention, flexing or extending strokes may be repeated in a serial, alternating, or mixed serial/alternating sequence to achieve the desired training effect.

3. BRIEF DESCRIPTION OF THE DRAWINGS

The invention will be more fully appreciated in light of the following detailed description, which is intended to be read in conjunction with the following set of drawings, in which.

DETAILED DESCRIPTION OF THE INVENTION

Figure 1:
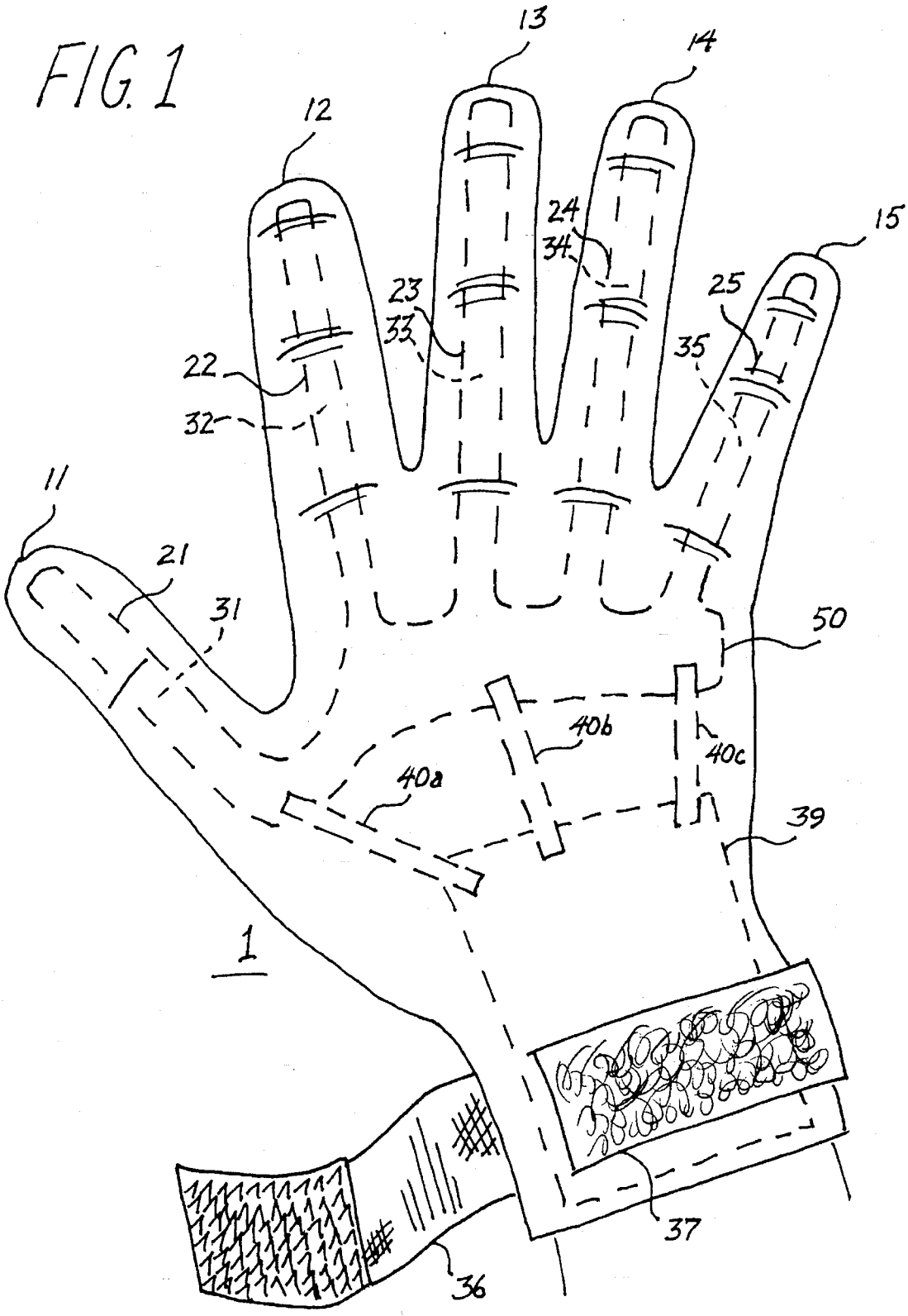
FIG. 1 depicts a top view of a first embodiment of the glove.

Reference is now made to FIG. 1, which depicts a glove 1 for exercising one or more of fingers 11, 12, 13, 14 and/or 15. Glove 1 is preferably formed from a molded, elastomer or engineering plastic material, and may optionally incorporate an inner cloth-like liner. For example, polypropylene may be used as an inner liner to wick sweat away from the wearer's hand, which could be significant during use.

A plurality of optional extension support members 21–25 are embedded along the top side of respective fingers 11–25. Extension support members 21–25 increase the resistance as fingers 11–15 move from a relaxed to an extended position.

A corresponding plurality of flexion support members 31–35 (visible in FIG. 2 but not FIG. 1) are optionally embedded along the underside of respective fingers 11–15. Flexion support members 31–35 increase the resistance as fingers 11–15 move from a relaxed to a flexed position.

An optional support means, illustratively depicted as including an embedded support plate 39, a wrist strap 36 and Velcro® type fastenings 37–38, affixes to the user's wrist and provides size adjustment for different users. Optional linking members **40*a–c* connect optional support plate 39 with an optional support member base plate 50** and provide increased structural rigidity.

Figure 2:
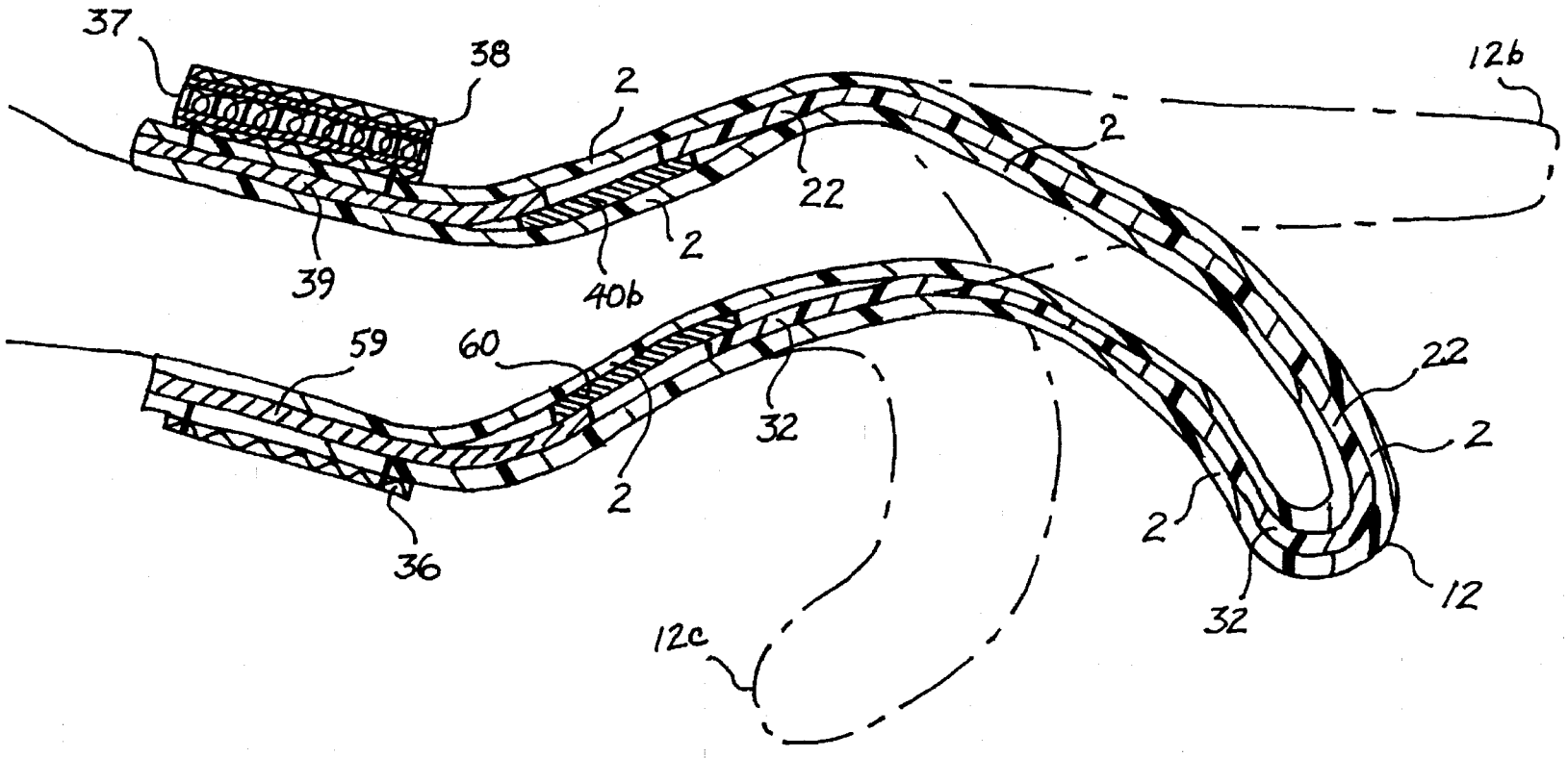
FIG. 2 depicts a cross-sectional view of the first embodiment of the glove; and, FIG. 3 depicts a side view of a second embodiment of the glove.

Reference is now made to FIG. 2, which depicts a cross-sectional view of the glove 1. Index finger 12 is shown in a relaxed position. Outline **12*b* depicts the extended position of index finger 12. Similarly, outline 12*c* depicts the flexed position of finger 12**.

In accordance with one aspect of the invention, a method for exercising finger 12 comprises the steps of resisting the motion of finger 12 from its relaxed position to an extended position **12*b* or to a flexed position 12*c***. Each such motion represents a training stroke, which, in accordance with the invention, is preferably repeated in a prescribed sequence to achieve the desired training effect.

Referring still to FIG. 2, glove 1 is formed principally from a molded, elastic material 2. Optionally embedded in elastic material 2 are an extension support member 22 and a flexion support member 32. Such support members are preferably formed from a plastic or metallic material and are shaped to correspond to the relaxed contour of the finger 12. So shaped, support members 22 and 32 provide increased resistance as the finger 12 extends or flexes from the relaxed position. Alternatively, elastic material 2 could be replaced by a nonelastic material, and members 22 and 32 could provide the requisite support and flexion.

Also shown in FIG. 2 are two optional embedded support plates 39 and 59, as well as respective linking members **40*b* and 60. Plates 39 and 59 could be used in any manner desirable, for example, to supplement the support and flexion characteristics of members 22 and 32**.

Figure 3:
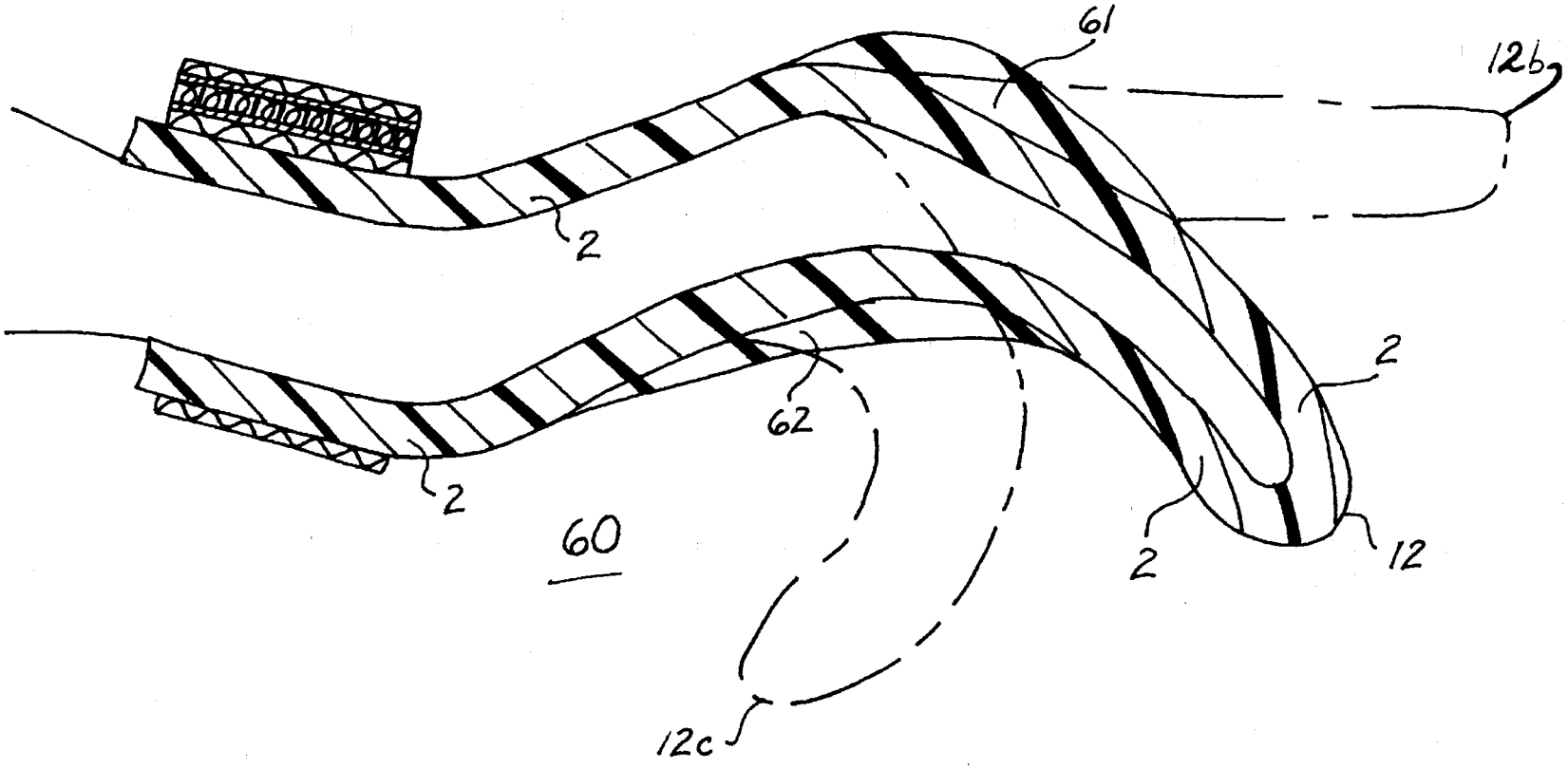

Reference is now made to FIG. 3, which depicts a side view of a second embodiment of a glove 60, formed from a molded, elastic material 2. Glove 60 is advantageously molded to include regions of enhanced thickness 61 and 62. Assuming that material 2 has a higher coefficient of compression than extension, region 61 provides increased resistance as the finger 12 moves to an extended position **12*b*. Similarly, region 62 provides increased resistance as the finger 12 moves to a flexed position 12*c***.

The embodiment depicted in FIG. 3 may also include any of the support members and plates illustrated in the FIGS. 1–2 embodiment. Preferably, however, an elastic material is selected to form the glove 60 that obviates the need for such internal or external support members or plates. For example, polymers that have a high resistance to cracking during a high number of repetitive flexes, while maintaining the desired shape at rest, and further, maintaining the proper degree of resistance, even after extensive repeated flexing, are suitable for forming the glove 60. In particular, widely available elastomers and engineering plastics may be used. Additionally, molded copolyester foams, as described below, may be appropriate.

In general, copolyetherester polymers consist essentially of a multiplicity of recurring intralinear long-chain and short-chain ester units.

The term "long-chain ester units" as applied to units in the copolyetherester polymer chain refers to the reaction product of long-chain glycols with dicarboxylic acids. The long-chain glycols are polymeric glycols having terminal (or as nearly terminal as possible) hydroxy groups and a molecular weight of from about 400–6000. The long-chain glycols used to prepare the copolyetheresters useful in forming the exercise glove are poly-(alkylene oxide) glycols having a carbon-to-oxygen ratio of about 2.0–4.3.

Representative long-chain glycols are poly(ethylene oxide) glycol, poly (1,2-and 1,3-propylene oxide) glycols, poly(tetramethylene oxide) glycol, random or block copolymers of ethylene oxide and 1,2-propylene oxide, and random or block copolymers of tetrahydrofuran with minor amounts of a second monomer such as 3-methyltetrahydrofuran (used in proportions such that the carbon-to-oxygen ratio in the glycol does not exceed about 4.3).

The term "short-chain ester units" as applied to units in the polymer chain refers to low molecular weight compounds or polymer chain units having molecular weights less than about 550. They are made by reacting one or more low molecular weight saturated or unsaturated diols (below about 250) with one or more dicarboxylic acids to form ester units.

Included among the low molecular weight diols which react to form short-chain ester units are saturated and/or unsaturated aliphatic, cycloaliphatic, and aromatic dihydroxy compounds. Preferred are diols with 2–15 carbon atoms such as ethylene, propylene, tetramethylene, pentamethylene, 2,2-dimethyltrimethylene, hexamethylene and decamethylene glycols; dihydroxy cyclohexane; cyclohexane dimethanol; resorcinol; hydroquinone; 1,5-dihydroxy naphthalene; or mixtures of any or more of these diols with unsaturated diols such as butene-diol, hexenediol, etc. Especially preferred are saturated aliphatic diols, mixtures thereof or a mixture of saturated diol(s) with an unsaturated diol(s), each diol containing 2–8 carbon atoms.

Included among the bis-phenols which can be used are bis(p-hydroxy) diphenyl, bis (p-hydroxyphenyl) methane, and bis(p-hydroxyphenyl) propane. Equivalent ester forming derivatives of these diols are also useful (e.g., ethylene oxide or ethylene carbonate can be used in place of ethylene glycol). The term "low molecular weight diols" as used herein should be construed to include such equivalent ester-forming derivatives; provided, however, that the molecular weight requirement pertains to the diol only and not to its derivatives.

Dicarboxylic acids which are reacted with the foregoing long-chain glycols and low molecular weight diols to produce the copolyesters useful in forming the glove of the present invention are aliphatic, cycloaliphatic, or aromatic dicarboxylic acids of a low molecular weight, i.e., having a molecular weight of less than about 300. The term "dicarboxylic acids" as used herein includes equivalents of dicarboxylic acids having two functional carboxyl groups which perform substantially like dicarboxylic acids in reaction with glycols and diols in forming copolyester polymers. These equivalents include esters and ester-forming derivatives, such as acid halides and anhydrides. The molecular weight requirement pertains to the acid and not to its equivalent ester or ester-forming derivative. Thus, an ester or a dicarboxylic acid having a molecular weight greater than 300 or an acid equivalent of a dicarboxylic acid having a molecular weight greater than 300 are included provided the acid has a molecular weight below about 300. The dicarboxylic acids can contain any substituent groups or combinations which do not substantially interfere with the copolyester polymer formation and use of the polymer.

Aliphatic dicarboxylic acids, as the term is used herein, refers to carboxylic acids having two carboxyl groups each attached to a saturated carbon atom. If the carbon atom to which the carboxyl group is attached is saturated and is in a ring, the acid is cycloaliphatic.

Aromatic dicarboxylic acids, as the term is used herein, are dicarboxylic acids having two carboxyl groups attached to a carbon atom in an isolated or fused benzene ring. It is not necessary that both functional carboxyl groups be attached to the same aromatic ring and where more than one ring is present, they can be joined by aliphatic or aromatic divalent radicals or divalent radicals such a —O— or —$SO_2$—.

Representative aliphatic and cycloaliphatic acids which can be used are sebacic acid, 1,3-cyclohexane dicarboxylic acid, 1,4cyclohexane dicarboxylic acid, adipic acid, glutaric acid, succinic acid, oxalic acid, azelaic acid, diethylmalonic acid, allylmalonic acid, 4-cyclohexene-1,2-dicarboxylic acid, 2-ethylsuberic acid, tetramethylsuccinic acid, cyclopentanedicarboxylic acid, decahydro-1,5-naphthalene dicarboxylic acid, 4,4'-bicyclohexyl dicarboxylic acid, decahydro-2,6-naphthalene dicarboxylic acid, 4,4'-methylene bis(cyclohexane carboxylic acid), 3,4-furan dicarboxylic acid, and 1,1-cyclobutane dicarboxylic acid. Preferred aliphatic acids are cyclohexane-dicarboxylic acids and adipic acid.

Representative aromatic dicarboxylic acids which can be used include terephthalic, phthalic and isophtalic acids, bi-benzoic acid, substituted dicarboxy compounds with two benzene nuclei such as bis(p-carboxyphenyl) methane, oxybis(benzoic acid) ethylene-bis-(p-oxybenzoic acid), 1,5-naphthalene dicarboxylic acid, 2,6-naphthalene dicarboxylic acid, 2,7-naphthalene dicarboxylic acid, phenanthrene dicarboxylic acid, anthracene dicarboxylic acid, 4,4'-sulfonyl dibenzoic acid, and $C_1$–$C_{12}$ alkyl and ring substitution derivatives thereof, such as halo, alkoxy, and aryl derivatives. Hydroxyl acids such as p(-hydroxyethoxy) benzoic acid can also be used providing an aromatic dicarboxylic acid is also present.

Aromatic dicarboxylic acids are an especially preferred class for preparing the copolyetherester polymers useful in forming the exercise glove. Among the aromatic acids, those with 8–16 carbon atoms are preferred, particularly the phenylene dicarboxylic acids, i.e., phthalic, terephthalic and isophthalic acids and their dimethyl derivatives.

It is preferred that at least about 30% of the short segments are identical and that the identical segments form a homopolymer in the fiber forming molecular weight range (molecular weight 5000) having a melting point of at least 150° C. and preferably greater than 200° C. Copolyetheresters meeting these requirements exhibit a useful level of properties such as tensile strength and tear strength. Polymer melting points are conveniently determined by a differential scanning calorimeter.

The short-chain ester units will constitute about 15–95 weight percent of the copolyetherester. The remainder of the copolyetherester will be the long segments, thus the long segment will comprise about 5–85 weight percent of the copolyetherester. Copolyetheresters in which the short-chain units comprise 25–90 weight percent with 10–75 weight percent long-chain units are preferred.

Preferred copolyetheresters are those prepared from dimethyl terephthalate, 1,4 butanediol, and poly(tetramethylene oxide) glycol having a molecular weight of about 600 to about 2000 or poly(ethylene oxide) glycol having a molecular weight of about 600–1500. Optionally up to about 30 mole percent, preferably 5–20 mole percent of the dimethyl terephthalate in these polymers can be replaced by dimethylphthalate or dimethyl isophthalate. Other preferred copolyetheresters are those prepared from dimethyl terephthalate, poly(tetramethylene oxide) glycol having a molecular weight of about 600 to about 2000, and a mixture of 1,4 butanediol with up to 50 mole percent, preferably from about 10 to about 40 mole percent of 1,6 hexanediol or 1,4 butanediol. The polymers based on poly(tetramethylene oxide) glycol are especially preferred because they are easily prepared, have overall superior physical properties, and are especially resistant to water.

It is sometimes advisable to stabilize certain of the compositions to heat or radiation by ultraviolet light. This can be done by incorporating stabilizers in the polyester compositions. Satisfactory stabilizers comprise phenols and their derivatives, amines and their derivatives, compounds containing both hydroxyl and amine groups, hydroxyazines, oximes, polymeric phenolic esters and salts of multivalent metals in which the metal is in its lower state.

Representative phenol derivatives useful as stabilizers include 3,5-di-tert-butyl-4-hydroxy hydrocinnamic triester with 1,3,5-tris-(2-hydroxyethyl-s-triazinen-2,4,6-(1H, 3H, 5H) trione, 4,4'-bis(2,6-ditertiary-butylphenyl), 1,3,5-trimethyl-2,4,6-tris (3,5-ditertiary-butyl-4-hydroxylbenzyl)benzene and 4,4'-butylidene-bis(6-tertiarybutyl-m-cresol). Various inorganic metal salts or hydroxides can be used as well as organic complexes such as nickel dibutyl dithiocarbamate, manganous salicylate and copper 3-phenylsalicylate. Typically amine stabilizers include N, N"-bis (betanaphthyl)-p-phenylenediamine, N,N'-bis (1-methylheptyl)-p-phenylene diamine and either phenyl-beta-napthyl amine or its reaction products with aldehydes. Mixtures of hindered phenols with esters of thiodipropionic acid, mercaptides and phosphite esters are particularly useful. Additional stabilization to ultraviolet light can be obtained by compounding with various UV absorbers such as substituted benzophenones and/or benzotriazoles.

The properties of these copolyesters can be modified by incorporation of various conventional inorganic fillers such as carbon black, mica, talc, silica gel, alumina, clays and chopped fiberglass. These may be incorporated in amounts up to 50% by weight, preferably up to about 25% by weight.

The low density copolyetherester polymer composition useful in forming the exercise glove may also contain, with or without the reinforcing agents or fillers, one or more high molecular weight thermoplastic polymers. Suitable high molecular weight thermoplastic polymers include polyesters, polycarbonates, polyolefins, styrene resins and copolymers of these and the like. Preferred are blends with polyesters and aromatic polycarbonates. Especially preferred are the poly(alkylene terephthalate) polyesters, particularly poly(ethylene terephthalate) and poly(butylene terephthalate). These blends are known in the art and are generally described in U.S. Pat. Nos. 3,718,175; 3,907,926; 3,963,802; 4,124,653; 4,140,670; 4,157,325 and 4,184,997 and UK Pat. No. 1,431,916, among others, all incorporated herein by reference.

Briefly, polyesters suitable for use in the copolyetherester polyesters blends used to form the exercise glove of the present invention are derived from one or more aliphatic and/or cycloaliphatic glycols and one or more aromatic dicarboxylic acids. The glycol may be selected from the group consisting essentially of ethylene glycol; 2 methyl-1,3 propanediol; 1,4-butanediol; 1,5-pentanediol; 1,6-hexanediol and 1,4-cyclohexanedimethanol, and the like. Suitable dicarboxylic acids include terephthalic acid, phthalic acid, isophthalic acid and naphthalene 2,6-dicarboxylic acid. The polyesters used to form the exercise glove may also contain minor amounts of other units such as aliphatic dicarboxylic acids and/or aliphatic polyols to form copolyesters. Preferred polyesters include poly(ethylene terephthalate), poly(butylene terephthalate) and blends thereof.

The polyesters described herein are either commercially available or can be produced by methods well know in the art, such as those set forth in U.S. Pat. Nos. 2,465,319; 3,047,539 and 2,910,466, herein incorporated by reference. Further, the polyesters used herein have an intrinsic viscosity of from about 0.4 to about 2.0 dl/g as measured in 60:40 phenol/tetrachloroethane mixture or a similar solvent at 30° C.

Similarly, any of the polycarbonates known in the art may be blended with the copolyetheresters described above. Especially preferred are aromatic polycarbonates, particularly homopolymers, copolymers and mixtures thereof, which have an intrinsic viscosity of from about 0.3 to about 1.0 dl/g as measured in methylene chloride at 25° C.

Generally, the aromatic polycarbonates are prepared by reacting a dihydric phenol with a carbonate precursor such as phosgene, a haloformate or a carbonate ester. Typical of the dihydric phenols that may be employed are 2,2-bis(4-hydroxyphenyl)propane; bis(4-hydroxyphenyl)methane; 2,2-bis(hydroxy-3-methylphenyl)propane; (3,3'-dichloro-4,4'-dihydroxy diphenyl)methane and the like. The aromatic polycarbonates may be formed in accordance with the methods set forth in U.S. Pat. Nos. 2,999,835; 3,028,365; 2,999,844; 4,018,750 and 4,123,435, all incorporated herein by reference, as well as other processes known to those skilled in the art.

The polycarbonates so produced are typified as possessing recurring structural units of the formula $$—(A—O—C—O)_n—$$

wherein A is a divalent aromatic radical of the dihydric phenol employed in the polymer producing reactions and n is greater than 1, preferably from about 10 to about 400.

It is of course possible to employ two or more different dihydric phenols or a dihydric phenol in combination with a glycol, a hydroxy or acid terminated polyester, or a dibasic acid in the event a carbonate copolymer or copolyester carbonate rather than a homopolymer polycarbonate is desired. Thus, it should be understood that the term "polycarbonate resin" embraces within its scope carbonate copolymers.

Suitable copolymers also include those polycarbonate copolymers which comprise units derived from a first dihydric phenol which is a bis(hydroxyaryl)sulfone and a second dihydric phenol such as 2,2-bis(4-hydroxyphenyl)propane as disclosed in U.S. Pat. Nos. 3,737,409; and 2,999,846.

Suitable styrene resins include homopolymers, copolymers and graft copolymers thereof. Especially preferred styrene resins include homopolymer polystyrene, ABS type graft copolymers, and core-shell type graft copolymers as disclosed in U.S. Pat. Nos. 4,180,494; 3,808,180; 4,096,202; 4,260,693 and 4,292,233. Also preferred are rubber modified polystyrene such as a butadiene rubber modified polystyrene also referred to as high impact polystyrene or HIPS; styrene-butadiene-styrene block copolymer such as the Kraton or Kraton-G polymers that are described in U.S. Pat. Nos. 3,646,162 and 3,595,942; the modified alpha and para substituted styrenes or any of the styrene resins disclosed in U.S. Pat. No. 3,383,435, all of the aforementioned patents herein incorporated by reference.

Suitable olefin polymers and copolymers include polyethylene, polypropylene and ethylene-vinyl acetate copolymers and ethylene ethylacrylate copolymers, respectively. Such polyolefins are well known in the art.

Finally, it is also possible to use blends of the foregoing high-molecular weight thermoplastics in the compositions used to form the exercise glove. For example, one may use a combination of polycarbonate and a styrene resin, e.g. ABS or a core-shell graft copolymer. Other suitable combinations will be obvious to one skilled in the art.

The foregoing filled or unfilled, reinforced or unreinforced copolyetherester polymer and copolyetherester blend compositions may be foamed by use of suitable blowing agents, with or without nucleating agents, to produce low density injection molded foams. Specifically, only a select few of the many known blowing agents and classes of blowing agents are suitable for this purpose. More specifically, azodicarbonamide and modified azodicarbonamides, p-toluene sulfonyl semicarbazide, citric acid, sodium bicarbonate, citric acid/sodium bicarbonate concentrate and aliphatic azoesters, all having activation or decomposition temperatures within the range of from about 160° C. to 250° C., preferably from about 185° C. to about 215° C. may be used with or without nucleating or activating agents to foam low density thermoplastics.

Azocarbonamide and modified azocarbonamides are well known and widely available commercially. Commercial grades and sources for these blowing agents include Celogen AZ series from Uniroyal Chemicals, Ficel series from BFC Chemicals, Ninopore and Kempore MC series from Olin Chemical, Chemocal series from Clark Cooper Corporation, Azocel from Fairmont Chemical Company and Vinyfor series from A&S Corporation.

The thermal decomposition range for the azodicarbonamide is from about 195° C. to about 215° C. Modified versions have a broader decomposition range, generally from about 160° C., and below, to 230° C. depending upon the modification. Most often, a modified azodicarbonamide is one which employs an additive as protective agents or activator and the like. Primarily, these adjuncts lower the decomposition temperature and increase the decomposition rate of the azodicarbonamide. Examples of the modifying additives include vinyl stabilizers containing basic salts of lead, cadmium or zinc, polyols, e.g., glycols and glycerol; and certain dibasic acids, e.g., oxalic and p-tolunesulfonic acids.

The thermal decomposition products of the azodicarbonamides generally comprise about 32% by weight of gaseous products and about 68% by weight of residue. The gaseous products primarily consist of nitrogen, carbon monoxide and carbon dioxide with minor amounts of ammonia, depending upon the particular source and grade of azodicarbonamide used, and the solid products consist essentially of urazol, biurea, cyamelide and cyanuric acid.

Sulfonyl semicarbazides are another class of suitable blowing agents. Especially, preferred is p-toluene sulfonyl semicarbazide. This is a known blowing agent and is available from commercial sources including Uniroyal Chemicals under the tradename Celogen RA. P-toluene sulfonyl carbazide has a decomposition temperature range of from about 228° C.–235° C., however, this can be lowered by the use of certain activators including lead stearate and BIK, barium stearate, zinc oxide and the like. Gaseous decomposition products are essentially the same as for the azodicarbonamides; however, the solid decomposition products consist essentially of ditolyl disulfide and ammonium p-toluene sulfonate.

Aliphatic azoesters are another class of satisfactory blowing agents. The decomposition temperature range for these is very broad, generally from about 180° C. to about 270° C. A most preferred azoester is 2,2-azobis-(2-acetoxy propane). This is available from several sources including Pennwalt Corporation under the tradename Luazo-AP. These are somewhat preferable to either of the aforementioned classes of blowing agents because the gaseous decomposition product is essentially 100% nitrogen. Thus, there is no ammonia gas generated which is believed to cause discoloration and to attack the thermoplastic material.

The most preferred blowing agents, however, are citric acid, sodium bicarbonate and citric acid/sodium bicarbonate concentrate blowing agents. These also are known blowing agents and are available from many commercial sources including C. H. Boehringer Sohn under the tradename Hydrocerol. Especially preferred are the Hydrocerol-A (hydrophobized anhydrous citric acid). Hydrocerol-HT sodium bicarbonate and Hydrocerol Compound (citric acid/sodium bicarbonate). Their decomposition temperature range is generally from about 150° C. to about 210° C., and the sole gaseous decomposition product is carbon dioxide. These are preferred because neither the gaseous nor the solid decomposition products have deleterious effects on the thermoplastic copolyetherester. Furthermore, unlike the above-mentioned blowing agents, these blowing agents do not need the presence of nucleating agents or activators in order to achieve uniformity of cells, although it is preferred. Additionally, these blowing agents produced foams having the most uniform, fine cellular structure.

The foaming agent can be added as a solid powder, as a dispersion in an inert liquid or with a diluent such as silica or a neutral clay or as a concentrate wherein a high concentration of the foaming agent is carried in a carrier polymer such as, for example, polyethylene. The particle size of the foaming agent is usually sufficiently small to facilitate uniform blending with the thermoplastic polymer and is generally less that about 50 microns. However, since many commercial foaming agents are available in aggregate form, the particular size of the aggregate will be somewhat larger.

The amount of blowing agent dispersed in the low-modulus thermoplastic is that amount which is sufficient to provide a uniform, essentially closed cell foam manifesting the desired weight reduction and other physical properties. The density of the foam is preferably in the range of about 0.4 to 1.2 g/cc, more preferably from about 0.7 to 1.0 g/cc.

The amount of blowing agent used for the desired foam density will depend, inter alia, on the particular blowing agent selected and on the amount of gas generated by it upon decomposition. In general, the amount will range from about 0.05 to about 1.5% by weight based on the polymer, preferably from about 0.1 to about 0.8% by weight, based on the polymer, to provide a sufficient degree of foaming without yielding an undesirably low density or open pore structure.

Further, as noted above, the copolyetherester compositions may contain fillers and or reinforcing agents which tend to increase flexural modulus. However, many of these adjuncts, particularly carbon powder, glass, mica, talc, clay, fumed silica and the like are useful in the present invention as activators or nucleating agents for the foaming action. Their presence helps to produce a more uniform foam and is preferred. This benefit is achieved even at low levels of incorporation, i.e., even less than that amount needed in order to achieve reinforcement as with, for example, glass.

The copolyetherester foams used to form the exercise glove may also be rendered flame retardant by use of suitable flame retardant agents. The flame retardant may be premixed with the low-modulus thermoplastic copolyetheresters or blends thereof, or added during processing of the foam itself. Suitable flame retardant agents are as disclosed in U.S. Pat. Nos. 3,751,400; 3,855,277 and 3,975,905. Especially preferred are the polymeric and oligomeric flame retardant agents comprising tetrabromobisphenol-A carbonate units, see for example U.S. Pat. No. 3,866,685. All of the aforementioned patents are incorporated herein by reference. Other preferred flame retardant agents are known in the art and include brominated epoxy compounds. It is also contemplated that the foregoing flame retardants may be used in combination with synergists including, for example, antimony compounds.

By using the enumerated blowing agents, a low density copolyester foam may be obtained by using standard injection molding equipment rather than the expensive, complicated extrusion equipment presently necessary. See, e.g., U.S. Pat. No. 4,988,740 incorporated herein by reference. Furthermore, the blowing agents are environmentally acceptable, in contrast to the hydrocarbons (which are flammable) and halogenated hydrocarbons (which destroy the ozone layer) of the prior art.

While the method and apparatus of the present invention has been described with reference to a few presently preferred embodiments and methods for making and using the same, those skilled in the art will, in light of this disclosure, recognize that various alternative embodiments and extensions of the basic inventive concept are possible. Therefore, the scope of the present invention shall be limited only in accordance with the following claims.

What is claimed is:

1. An exercise glove, comprising:

support and biassing means having the shape of the human hand, including a hand receiving portion and separate, individual finger receiving stalls for removably enclosing the hand and fingers of a wearer and biassing the hand into a relaxed position in which the wrist is cocked up 30° and the fingers and thumb are positioned in their relaxed, equilibrium positions, approximately one-third closed; and resistance means, formed integrally with said support and biassing means, for resisting the flexion and extension of one or more of the wearer's fingers from said relaxed position.

2. A glove according to claim 1 wherein said support and biassing means and said resistance means are molded from the same material, said material being selected from the group consisting of elastomers and engineering plastics.

3. A glove according to claim 2 wherein said material is neoprene.

4. A glove according to claim 2 wherein said material is a copolyester foam.

5. A glove according to claim 1 wherein said resistance means are disposed along the outer side of one or more of said finger stalls to resist the extension of said fingers.

6. A glove according to claim 1 wherein said resistance means are disposed along the inner side of one or more of said finger stalls to resist the flexion of said fingers.

7. A glove according to claim 1 further comprising a liner disposed within said support and means.

8. A glove according to claim 7 wherein said liner is polypropylene.

* * * * *